US009576583B1

(12) United States Patent
Betts

(10) Patent No.: US 9,576,583 B1
(45) Date of Patent: Feb. 21, 2017

(54) RESTORING AUDIO SIGNALS WITH MASK AND LATENT VARIABLES

(71) Applicant: David Anthony Betts, Cambridge (GB)

(72) Inventor: David Anthony Betts, Cambridge (GB)

(73) Assignee: Cedar Audio LTD (GB)

( * ) Notice: Subject to any disclaimer, the term of this patent is extended or adjusted under 35 U.S.C. 154(b) by 142 days.

(21) Appl. No.: 14/557,014

(22) Filed: Dec. 1, 2014

(51) Int. Cl.
*G10L 21/02* (2013.01)
*G10L 21/0216* (2013.01)
*G10L 21/0264* (2013.01)
*G10L 19/00* (2013.01)

(52) U.S. Cl.
CPC ..... *G10L 19/0017* (2013.01)

(58) Field of Classification Search
CPC .. G10L 21/02; G10L 21/0216; G10L 21/0232; G10L 21/0264
USPC ..... 704/226, 278; 381/94.2, 94.3
See application file for complete search history.

(56) References Cited

U.S. PATENT DOCUMENTS 7,978,862 B2 7/2011 Betts
8,015,003 B2 * 9/2011 Wilson ..... G10L 21/0208 704/226
8,374,855 B2 * 2/2013 Hetherington ..... G10L 21/0208 704/226
2005/0123150 A1 * 6/2005 Betts ..... G10L 21/0208 381/94.3
2006/0064299 A1 * 3/2006 Uhle ..... G10L 21/0272 704/212
2010/0030563 A1 * 2/2010 Uhle ..... G10L 19/008 704/500
2011/0235823 A1 * 9/2011 Betts ..... G10L 21/0208 381/94.4
2014/0114650 A1 * 4/2014 Hershey ..... G10L 21/0232 704/203
2014/0201630 A1 * 7/2014 Bryan ..... G10L 21/0272 715/716
2015/0242180 A1 * 8/2015 Boulanger-Lewandowski ..... G06N 3/0445 700/94

* cited by examiner

*Primary Examiner* — Martin Lerner
(74) *Attorney, Agent, or Firm* — Tarolli, Sundheim, Covell & Tummino LLP

(57) ABSTRACT

We describe techniques for restoring an audio signal. In embodiments these employ masked positive semi-definite tensor factorization to process the signal in the time-frequency domain. Broadly speaking the methods estimate latent variables which factorize a tensor representation of the (unknown) variance/covariance of an input audio signal, using a mask so that the audio signal is separated into desired and undesired audio source components. In embodiments a masked positive semi-definite tensor factorization of $\psi_{ftk}=M_{ftk}U_{fk}V_{tk}$ is performed, where M defines the mask and U, V the latent variables. A restored audio signal is then constructed by modifying the input signal to better match the variance/covariance of the desired components.

23 Claims, 4 Drawing Sheets

RESTORING AUDIO SIGNALS WITH MASK AND LATENT VARIABLES

FIELD OF THE INVENTION

This invention relates to methods, apparatus and computer program code for restoring an audio signal. Preferred embodiments of the techniques we describe employ masked positive semi-definite tensor factorisation to process the audio signal in the time-frequency domain by estimating factors of a covariance matrix describing components of the audio signal, without knowing the covariance matrix.

BACKGROUND TO THE INVENTION

The introduction of unwanted sounds is a common problem encountered in audio recordings. These unwanted sounds may occur acoustically at the time of the recording, or be introduced by subsequent signal corruption. Examples of acoustic unwanted sounds include the drone of an air conditioning unit, the sound of an object striking or being struck, coughs, and traffic noise. Examples of subsequent signal corruption include electronically induced lighting buzz, clicks caused by lost or corrupt samples in digital recordings, tape hiss, and the clicks and crackle endemic to recordings on disc.

We have previously described techniques for attenuation/removal of an unwanted sound from an audio signal using an autoregressive model, in U.S. Pat. No. 7,978,862. However improvements can be made to the techniques described therein.

SUMMARY OF THE INVENTION

According to the present invention there is therefore provided a method of restoring an audio signal, the method comprising: inputting an audio signal for restoration; determining a mask defining desired and undesired regions of a time-frequency spectrum of said audio signal, wherein said mask is represented by mask data; determining estimated values for a set of latent variables, a product of said latent variables and said mask factorising a tensor representation of a set of property values of said input audio signal; wherein said input audio signal is modelled as a set of audio source components comprising one or more desired audio source components and one or more undesired audio source components, and wherein said tensor representation of said property values comprises a combination of desired property values for said desired audio source components and undesired property values for said undesired audio source components; and reconstructing a restored version of said audio signal from said desired property values of said desired source components.

Broadly speaking, in embodiments of the invention tensor factorisation of a representation of the input audio signal is employed in conjunction with a mask (unlike our previous autoregressive approach). The mask defines desired and undesired portions of a time-frequency representation of the signal, such as a spectrogram of the signal, and the factorisation involves a factorisation into desired and undesired source components based on the mask. However in embodiments the factorisation is a factorisation of an unknown covariance in the form of a (masked) positive semi-definite tensor, and is performed indirectly, by iteratively estimating values of a set of latent variables the product of which, together with the mask, defines the covariance. In embodiments a first latent variable is a positive semi-definite tensor (which may be a rank 2 tensor) and a second is a matrix; in embodiments the first defines a set of one or more dictionaries for the source components and the second activations for the components.

Once the latent variables have been estimated the input signal variance or covariance $\sigma_{ft}$ may be calculated. In a multi-channel (eg stereo) system the covariance is a matrix of C×C positive definite matrices; in a single channel (mono) system $\sigma_{ft}$ defines the input signal variance. The variance or covariance of the desired source components may also be estimated. Then the audio signal is adjusted, by applying a gain, so that its variance or covariance approaches that of the desired source components, to reconstruct a restored version of said audio signal.

The skilled person will understand that references to restoring/reconstructing the audio signal are to be interpreted broadly as encompassing an improvement to the audio signal by attenuating or substantially removing unwanted acoustic events, such as a dropped spanner on a film set or a cough intruding on a concert recording.

In broad terms, one or more undesired region(s) of the time-frequency spectrum are interpolated using the desired components in the desired regions. The desired and/or undesired regions may be specified using a graphical user interface, or in some other way, to delimit regions of the time-frequency spectrum. The 'desired' and 'undesired' regions of the time-frequency spectrum are where the 'desired' and 'undesired' components are active. Where the regions overlap, the desired signal has been corrupted by the undesired components, and it is this unknown desired signal that we wish to recover.

In principle the mask may merely define undesired regions of the spectrum, the entire signal defining the desired region. This is particularly where the technique is applied to a limited region of the time-frequency spectrum. However the approach we describe enables the use of a three-dimensional tensor mask in which each (time-frequency) component may have a separate mask. In this way, for example, separate different sub-regions of the audio signal comprising desired and undesired regions may be defined; these apply respectively to the set of desired components and to the set of undesired components. Potentially a separate mask may be defined for each component (desired and/or undesired). Further, the factorisation techniques we describe do not require a mask to define a single, connected region, and multiple disjoint regions may be selected.

In preferred implementations such an approach based on masked tensor factorisation, separating the audio into desired and undesired components, is able to provide a particularly effective reconstruction of the original audio signal without the undesired sounds: Experiments have established that the result gives an effect which is natural-sounding to the listener. It appears that the mask provides a strong prior which enables a good representation of the desired components of the audio signal, even if the representation is degenerate in the sense that there are potentially many ways of choosing a set of desired components which fit the mask.

Preferred embodiments of the techniques we describe operate in the time-frequency domain. One preferred approach to transform the input audio signal into the time-frequency domain from the time domain is to employ an STFT (Short-Time Fourier Transform) approach: overlapping time domain frames are transformed, using a discrete Fourier transform, into the time-frequency domain. The skilled person will recognise, however, that many alternative techniques may be employed, in particular a wavelet-based approach. The skilled person will further recognise that the audio input and audio output may be in either the analogue or digital domain.

In some preferred embodiments the method estimates values for latent variables $U_{fk}$, $V_{tk}$ where $$\psi_{ftk}=M_{ftk}U_{fk}V_{tk}$$

Here $\psi_{ftk}$ comprises a tensor representation of the variance/covariance values of the audio source components and $M_{ftk}$ represents the mask, f, t and k indexing frequency, time and the audio source components respectively. In particular the method finds values for $U_{fk}$, $V_{tk}$ which optimise a fit to the observed said audio signal, the fit being dependent upon $\sigma_{ft}$ where $\sigma_{ft}=\Sigma_k\psi_{ftk}$. Preferably the method uses update rules for $U_{fk}$, $V_{tk}$ which are derived either from a probabilistic model for $\sigma_{ft}$ (where the model is used for defining the fit to the observed audio signal), or a Bregmann divergence measuring a fit to the observed audio. Thus in embodiments the method finds values for $U_{fk}$, $V_{tk}$ which maximise a probability of observing said audio signal (for example maximum likelihood or maximum a posteriori probability). In embodiments this probability is dependent upon $\sigma_{ft}$, where $\sigma_{ft}=\Sigma_k\psi_{ftk}$. In embodiments $U_{fk}$ may be further factorised into two or more factors and/or $\sigma_{ft}$ and $\psi_{ftk}$ may be diagonal. In embodiments the reconstructing determines desired variance or covariance values $\sigma_{ft}=\Sigma_k\psi_{ftk}s_k$ where $s_k$ is a selection vector selecting the desired audio source components. A restored version of the audio signal may then be reconstructed by adjusting the input audio signal so that the (expected) variance or covariance of the output approaches the desired variance or covariance values $\tilde{\sigma}_{ft}$, for example by applying a gain as previously described.

In embodiments the (complex) gain is preferably chosen to optimise how natural the reconstruction of the original signal sounds. The gain may be chosen using a minimum mean square error approach (by minimising the expected mean square error between the desired components and the output (in the time-frequency domain), although this tends to over-process and over-attenuates loud anomalies. More preferably a "matching covariance" approach is used. With this approach the gains are not uniquely defined (there is a set of possible solutions) and the gain is preferably chosen from the set of solutions that has the minimum difference between the original and the output, adopting a 'do least harm' type of approach to resolve the ambiguity.

In a related aspect the invention provides a method of processing an audio signal, the method comprising: receiving an input audio signal for restoration; transforming said input audio signal into the time-frequency domain; determining, preferably graphically, mask data for a mask defining desired and undesired regions of a spectrum of said audio signal; determining estimated values for latent variables $U_{fk}$, $V_{tk}$ where $$\psi_{ftk}=M_{ftk}U_{fk}V_{tk}$$

wherein said input audio signal is modelled as a set of k audio source components comprising one or more desired audio source components and one or more undesired audio source components, and where $\psi_{ftk}$ comprises a tensor representation of a set of property values of said audio source components, where M represents said mask, and where f and t index frequency and time respectively; and reconstructing a restored version of said audio signal from desired property values of said desired source components.

The invention further provides processor control code to implement the above-described systems and methods, for example on a general purpose computer system or on a digital signal processor (DSP). The code is provided on a non-transitory physical data carrier such as a disk, CD- or DVD-ROM, programmed memory such as non-volatile memory (eg Flash) or read-only memory (Firmware). Code (and/or data) to implement embodiments of the invention may comprise source, object or executable code in a conventional programming language (interpreted or compiled) such as C, or assembly code, or code for a hardware description language. As the skilled person will appreciate such code and/or data may be distributed between a plurality of coupled components in communication with one another.

The invention still further provides apparatus for restoring an audio signal, the apparatus comprising: an input to receive an audio signal for restoration; an output to output a restored version of said audio signal; program memory storing processor control code, and working memory; and a processor, coupled to said input, to said output, to said program memory and to said working memory to process said audio signal; wherein said processor control code comprises code to: input an audio signal for restoration; determine a mask defining desired and undesired regions of a spectrum of said audio signal, wherein said mask is represented by mask data; determine estimated values for latent variables $U_{fk}$, $V_{tk}$ where $$\psi_{ftk}=M_{ftk}U_{fk}V_{tk}$$

wherein said input audio signal is modelled as a set of k audio source components comprising one or more desired audio source components and one or more undesired audio source components, and where $\psi_{ftk}$ comprises a tensor representation of a set of property values of said audio source components, where M represents said mask, and where f and t index frequency and time respectively; and reconstruct a restored version of said audio signal from said desired source components.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Figure 1A:
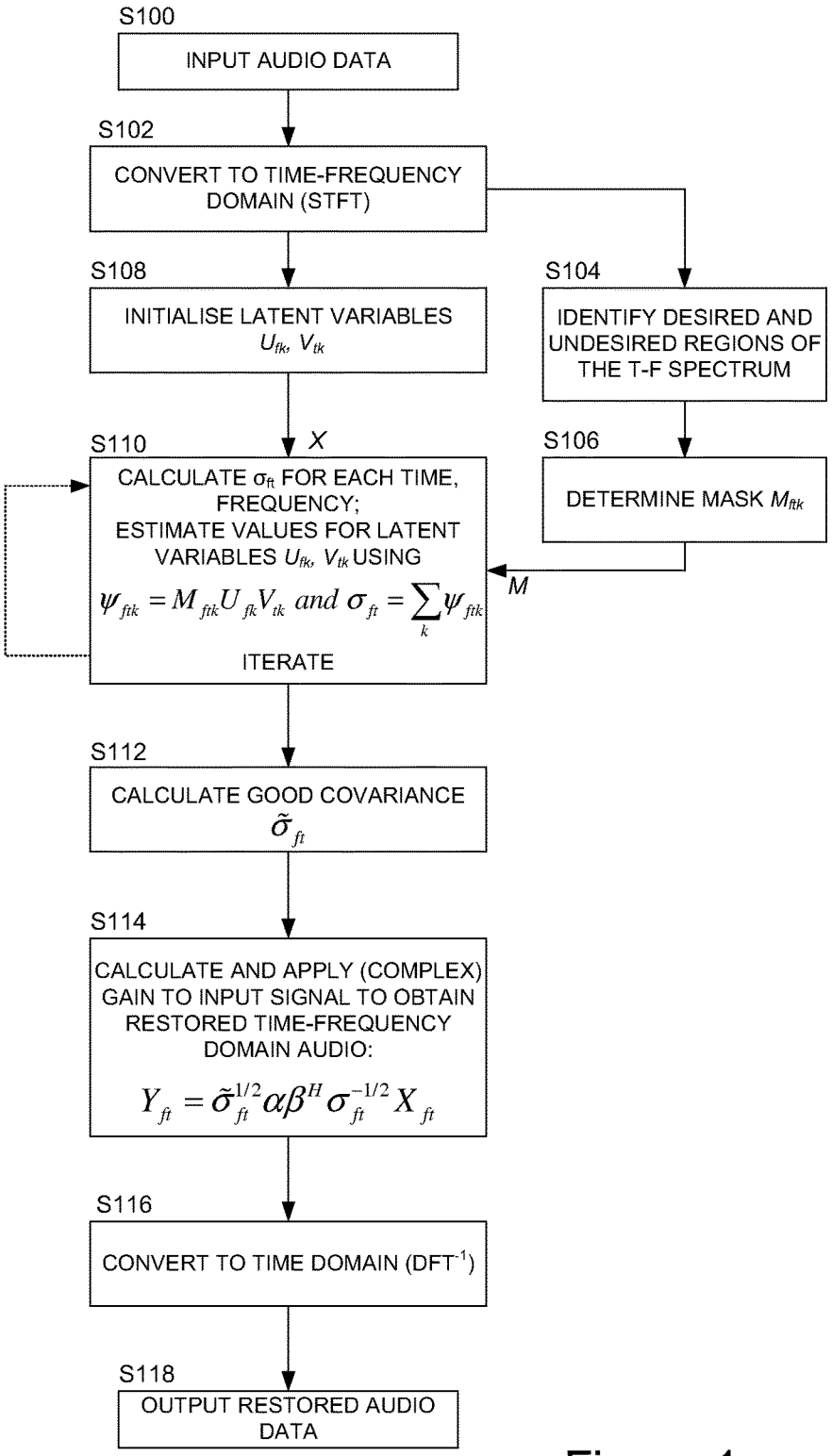
FIGS. 1*a* and 1*b* show, respectively, a procedure for performing audio signal restoration using masked positive semi-definite tensor factorisation (PSTF) according to an embodiment of the invention, and an example a graphical user interface which may be employed for the procedure of FIG. 1*a;*

Broadly speaking we will describe techniques for time-frequency domain interpolation of audio signals using masked positive semi-definite tensor factorisation (PSTF). To implement the techniques we derive an extension to PSTF where an a priori mask defines an area of activity for each component. In embodiments the factorisation proceeds using an iterative approach based on minorisation-maximisation (MM); both maximum likelihood and maximum a posteriori example algorithms are described. The techniques are also suitable for masked non-negative tensor factorisation (NTF) and masked non-negative matrix factorisation (NMF), which emerge as simplified cases of the techniques we describe.

The masked PSTF is applied to the problem of interpolation of an unwanted event in an audio signal, typically a multichannel signal such as a stereo signal but optionally a mono signal. The unwanted event is assumed to be an additive disturbance to some sub-region of the spectrogram. In embodiments the operator graphically selects an 'undesired' region that defines where the unwanted disturbance lies. The operator also defines a surrounding desired region for the supporting area for the interpolation. From these two regions binary 'desired' and 'undesired' masks are derived and used to factorise the spectrum into a number of 'desired' and 'undesired' components using masked PSTF. An optimisation criterion is then employed to replace the 'undesired' region with data that is derived from (and matches) the desired components.

We now describe some preferred embodiments of the algorithm and explain an example implementation. Preferably, although not essentially, the algorithm operates in a statistical framework, that is the input and output data is expressed in terms of probabilities rather than actual signal values; actual signal values can then be derived from expectation values of the probabilities (covariance matrix). Thus in embodiments the probability of an observation $X_{ft}$ is represented by a distribution, such as a normal distribution with zero mean and variance $\sigma_{ft}$.

STFT Framework

Overlapped STFTs provide a mechanism for processing audio in the time-frequency domain. There are many ways of transforming time domain audio samples to and from the time-frequency domain. The masked PSTF and interpolation algorithm we describe can be applied inside any such framework; in embodiments we employ STFT. Note that in multi-channel audio, the STFTs are applied to each channel separately.

Procedure

We make the premise that the STFT time-frequency data is drawn from a statistical masked PSTF model with unknown latent variables. The masked PSTF interpolation algorithm then has four basic steps.

- We use the STFT to convert the time domain data into a time-frequency representation.
- We use statistical inference to calculate either the maximum likelihood or the maximum posterior values for the latent variables. The algorithms work by iteratively improving an estimate for the latent variables.
- Given estimates for the latent variables, we use statistical inference to interpolate the unknown 'desired' data either by matching the expected 'desired' covariance or by minimising the expected mean square error of the interpolated data.
- We use the inverse STFT to convert the interpolated result back into the time domain.

Assumptions

Dimensions

C is the number of audio channels.

F is the number of frequencies.

T is the number of STFT frames.

K is the number of components in the PSTF model.

Notation

- $\triangleq$ means equal up to a constant offset which can be ignored.
- $\Sigma_{a,b}$ means summation over both indices a and b. Equivalent to $\Sigma_a\Sigma_b$
- Tr(A) is the trace of the matrix A.
- We define a tensor T by its element type $\mathbb{T}$ and its dimensions $D_0 \ldots D_{n-1}$. We notate this as $T\in[\mathbb{T}]_{D_0\times D_1\times \ldots \times D_{n-1}}$. Where there is no ambiguity we drop the square brackets for a more straightforward notation.

Positive Semi-Definite Tensor

A positive semi-definite tensor means a multidimensional array of elements where each element is itself a positive semi-definite matrix. For example, $U\in[\mathbb{C}_{C\times C}^{\geq 0}]_{F\times K}$.

Inputs

The parameters for the algorithm are

- $s\in R_K^{\{0,1\}}$, a selection vector indicating which components are 'desired' ($s_k$=1) or the 'undesired' ($s_k$=0). Obviously there should be at least one 'desired' component and at least one 'undesired' component. We get good results using $s=[1,1,0,0]^T$ i.e. factorise into 2 desired and 2 undesired components.

The input variables are:

- $X\in\mathbb{C}_{C\times F\times T}$, the overlapped STFT of the input time domain data.
- $M\in\mathbb{R}_{F\times T\times K}$, the time-frequency mask for each component (other non-negative values will also work; then the mask becomes an a-priori weighting function). The masks for each component $M_k$ will be either the 'support' mask for $s_k$=1 or the 'undesired' mask for $s_k$=0. In embodiments "1"s define the selected (desired or undesired) region.

Outputs

The output variables are:

- $Y\in\mathbb{C}_{C\times F\times T}$, the overlapped STFT of the interpolated time domain data.

Latent Variables

The masked PSTF model has two latent variables U, V which will be described later.

- $U\in[\mathbb{C}_{C\times C}^{\geq 0}]_{F\times K}$ is a positive semi-definite tensor containing a covariance matrix for each frequency and component.
- $V\in\mathbb{R}_{TK}^{\geq 0}$ is a matrix containing non-negative value for each frame and component.

Square Root Factorisations

At various points we use the square root factorisations of $R\in\mathbb{C}_{C\times C}^{\geq 0}$. This can be any factorisation $R^{1/2}$ such that $R=R^{1/2H}R^{1/2}$. For preference we use Cholesky factorisation, but care is required if R is indefinite. Note that all square root factorisations can be related using an arbitrary orthonormal matrix $\Theta$; if $R^{1/2}$ is a valid factorisation then so is $\Theta R^{1/2}$.

Multi-Channel Complex Normal Distribution

As part of our model we use, in this described example, a multi-channel complex circular symmetric normal distribution (MCCS normal). Such a distribution is defined in terms of a positive semi-definite covariance matrix $\sigma$ as:

$$x \in \mathcal{N}(0, \sigma)$$

$$p(x;\sigma) \propto \frac{1}{\det\sigma} e^{-x^H\sigma^{-1}x}.$$

With a log likelihood given by:

$$L(x;\sigma) \triangleq -\ln \det \sigma - x^H\sigma^{-1}x.$$

In the single channel case $\sigma$ becomes a positive real variance.

Derivation of the Masked PSTF Model

Observation Likelihood

We assume that the observation $X_{ft}$ is the sum of K unknown independent components $Z_{ftk}\in\mathbb{C}_C$. We also assume that each $Z_{ftk}$ is independently drawn from a MCCS normal distribution with an unknown covariance $\psi_{ftk}$ that varies over both time and frequency. Lastly we assume that the covariance $\psi_{ftk}$ satisfies a masked PSTF criterion which has latent variables $U_{fk} \in \mathbb{C}_{C\times C}^{>0}$ and $V_{tk} \in \mathbb{R}^{>0}$.

$$X_{ft} = \sum_k Z_{ftk} \tag{1}$$
$$Z_{ftk} \in \mathcal{N}(0, \psi_{ftk})$$
$$\psi_{ftk} = M_{ftk} U_{fk} V_{tk}.$$

Note that U and ψ are both positive semi-definite tensors.

The sum of normal independent distributions is also a normal distribution. We can derive an equation for the log likelihood of the observations given the latent variable as follows:

$$X_{ft} \in \mathcal{N}(0, \sigma_{ft}) \tag{2}$$
$$\sigma_{ft} = \sum_k \psi_{ftk}$$

$$L(X; U, V) \triangleq \sum_{f,t} -\ln\det \sigma_{ft} - X_{ft}^H \sigma_{ft} X_{ft}. \tag{3}$$

The positive semi-definite matrix $\sigma_{ft}$ is an intermediate variable defined in terms of the latent variables via eq(1) and eq(2).

The maximum likelihood estimates for U and V are found by maximising eq(3) as shown later.

Equation (3) can also be expressed in terms of an equivalent Itakura-Siato (IS) divergence, which leads to the same solutions for U and V as those given below. Although the derivation of the update rules for U and V employs a probabilistic framework, equivalent algorithms can be obtained using 'Bregman divergences' (which includes IS-divergence, Kullback-Leibler (KL)-divergence, and Euclidean distance as special cases). Broadly speaking these different approaches each measure how well U and V, taken together, provide a component covariance which is consistent with or "fits" the observed audio signal. In one approach the fit is determined using a probabilistic model, for example a maximum likelihood model or an MAP model. In another approach the fit is determined by using (minimising) a Bregmann divergence, which is similar to a distance metric but not necessarily symmetrical (for example KL divergence represents a measure of the deviation in going from one probability distribution to another; the IS divergence is similar but is based on an exponential rather than a multinomial noise/probability distribution). Thus although we will describe update rules based on maximum likelihood and MAP models, the skilled person will appreciate that similar update rules may be determined based upon divergence (the equivalent of the MAP estimator using regularisation rather than a prior).

Maximum Likelihood Estimator

In embodiments we find the latent variables that maximise the observation likelihood in eq (3). The preferred technique is a minorisation/maximisation approach that iteratively calculates improved estimates $\hat{U}$, $\hat{V}$ from the current estimates U, V.

Minorisation/Maximisation (MM) Algorithm

For minorisation/maximisation we construct an auxiliary function $L(\hat{U}, \hat{V}, U, V)$ that has the following properties:

$$L(U,V,U,V)=L(X;U,V)$$

$$\text{for all } \hat{U}\text{: } L(\hat{U},V,U,V)\leq L(X;\hat{U},V)$$

$$\text{for all } \hat{V}\text{: } L(U,\hat{V},U,V)\leq L(X;U,\hat{V}).$$

Maximising the auxiliary function with respect to $\hat{U}$ gives an improvement in our observation likelihood, as at the maximum we have $$L(X;\hat{U},V)\geq L(\hat{U},V,U,V)\geq L(X;U,V)$$

Similarly maximising the auxiliary function with respect to $\hat{V}$ will also improve the observation likelihood. Repeatedly applying minorisation/maximisation with respect to $\hat{U}$ and $\hat{V}$ gives guaranteed convergence if the auxiliary function is differentiable at all points.

There are of course any number of auxiliary functions that satisfy these properties. The art is in choosing a function that is both tractable and gives good convergence. A suitable minorisation in our case is given by:

$$\hat{\psi}_{ftk} = M_{ftk} \hat{U}_{fk} \hat{V}_{tk} \tag{4}$$
$$\hat{\sigma}_{ft} = \sum_k \hat{\psi}_{ftk}$$
$$L(\hat{U}, \hat{V}, U, V) = \sum_{t,f} -\ln\det \sigma_{ft} - Tr(\hat{\sigma}_{ft}\sigma_{ft}^{-1}) + C - X_{ft}^H \sigma_{ft}^{-H}\left(\sum_k \psi_{ftk}\hat{\psi}_{ftk}^{-1}\psi_{ftk}\right)\sigma_{ft}^{-1} X_{ft}.$$

Optimisation with Respect to $U_{Fk}$

Setting the partial derivative of eq(4) with respect to $\hat{U}_{fk}$ to zero gives an analytically tractable solution. We define two intermediate variables $A_{fk}, B_{fk} \in \mathbb{C}_{C\times C}^{>0}$:

$$A_{fk} = \sum_t \sigma_{ft}^{-1} V_{tk} M_{ftk} \tag{5}$$

$$B_{fk} = U_{fk}\left(\sum_t M_{ftk} V_{tk} \sigma_{ft}^{-1} X_{ft} X_{ft}^H \sigma_{ft}^{-1}\right) U_{fk} \tag{6}$$

The solution to $$\frac{\partial \mathcal{L}}{\partial \hat{U}_{fk}} = 0$$

is men given by $$\hat{U}_{fk} A_{fk} \hat{U}_{fk} = B_{fk} \tag{7}$$

The case where eq(7) is degenerate has to be treated as a special case. One possibility is to always add a small ϵ to the diagonals of both $A_{fk}$ and $B_{fk}$. This improves numerical stability without materially affecting the result.

Equation (7) may be solved by looking at the solutions to the slightly modified equation:

$$\hat{U}_{fk}^H A_{fk} \hat{U}_{fk} = B_{fk}.$$

subject to the constraint that $\hat{U}_{fk}$ is positive semi-definite (i.e. $U_{fk} = \hat{U}_{fk}^H$). The general solutions to this modified equation can be expressed in terms of square root factorisations and an arbitrary orthonormal matrix $\Theta_{fk}$. We have to choose $\Theta_{fk}$ to preserve the positive definite nature of $\hat{U}_{fk}$, which can be done by using singular value decomposition to factorise the matrix $B_{fk}^{1/2}A_{fk}^{1/2H}$:

$$B_{fk}^{1/2}A_{fk}^{1/2H}=\alpha\Sigma\beta^{H} \tag{8}$$

$$\Theta_{fk}=\beta\alpha^{H} \tag{9}$$

$$\hat{U}_{fk}=A_{fk}^{-\frac{1}{2}}\Theta_{fk}B_{fk}^{\frac{1}{2}}. \tag{10}$$

U Update Algorithm

So to update U given the current estimates of U, V we use the following algorithm:

1. Use eq (1) and (2) to calculate $\sigma_{ft}$ for each frame t and frequency f.
2. For each frequency f and component k:
   a. Use eq(5) and (6) to calculate $A_{fk}$ and $B_{fk}$.
   b. Use eq(8), (9) and (10) to calculate the updated $\hat{U}_{fk}$.
3. Copy $\hat{U}\rightarrow U$.

Optimisation with Respect to $V_{tk}$

Setting the partial derivative of eq(4) with respect to $\hat{V}_{tk}$ to zero gives an analytically tractable solution. We define two intermediate variables $\hat{A}_{tk}$, $\hat{B}_{tk}\in\mathbb{R}$:

$$A'_{tk}=\sum_{f}Tr(\sigma_{ft}^{-1}U_{fk})M_{ftk} \tag{11}$$

$$B'_{tk}=V_{tk}^{2}\sum_{t}M_{ftk}X_{ft}^{X}\sigma_{ft}^{-1}U_{fk}\sigma_{ft}^{-1}X_{ft} \tag{12}$$

The solution to $$\frac{\partial\mathcal{L}}{\partial\hat{V}_{tk}}=0$$

is then given by $$\hat{V}_{tk}=\sqrt{\frac{B'_{tk}}{A'_{tk}}}.$$

The case where eq(13) is degenerate has to be treated as a special case. One possibility is to always add a small $\epsilon$ to both $A'_{tk}$ and $B'_{tk}$.

V Update Algorithm

So to update V given the current estimates of U, V we use the following algorithm:

1. Use eq (1) and (2) to calculate $\sigma_{ft}$ for each frame t and frequency f.
2. For each frame t and component k:
   a. Use eq(11) and (12) to calculate $A'_{tk}$ and $B'_{tk}$.
   b. Use eq(13) to calculate the updated $\hat{V}_{tk}$.
3. Copy $\hat{V}\rightarrow V$.

Overall U, V Estimation Procedure

An overall procedure to determine estimates for U and V is thus:

1. initialise the estimates for U, V.
2. iterate until convergence: do either:
   (a) apply the U update algorithm.
   (b) apply the V update algorithm.

The initialisation may be random or derived from the observations X using a suitable heuristic. In either case each component should be initialised to different values. It will be appreciated that the calculations of Band B' above, in the updating algorithms, incorporate the audio input data X.

One strategy for choosing which latent variable to optimise is to alternate steps 2a and 2b above. (It will be appreciated that both U and V need to be updated, but they do not necessarily need to be updated alternately).

One straightforward criterion for convergence is to employ a fixed number of iterations.

Maximum Posterior Estimator

In alternative embodiments we can use a maximum posterior estimator.

If we have prior information about the latent variables U and V we can incorporate this into the model using Bayesian inference.

In our case we can use independent priors for all $U_{fk}$ and $V_{tk}$; an inverse matrix gamma prior for each $U_{fk}$ and an inverse gamma prior for each $V_{tk}$. These priors are chosen because they lead to analytically tractable solutions, but they are not the only choice. For example, gamma and matrix gamma distributions also lead to analytically tractable solutions when their scale parameters are in the range 0 to 1.

The priors on U have meta parameters $\alpha_{fk}\in\mathbb{R}^{>0}$, $\Omega_{fk}\in\mathbb{C}^{C\times C\geq 0}$. The priors on V have meta parameters $\alpha'_{tk}$, $\omega_{tk}\in\mathbb{R}^{>0}$.

The prior log likelihoods are then:

$$L(U)\triangleq\sum_{f,k}-(\alpha_{fk}+1)\ln\det U_{fk}-Tr\{\Omega_{fk}U_{fk}^{-1}\} \tag{14}$$

$$L(V)\triangleq\sum_{t,k}-(\alpha'_{tk}+1)\ln V_{tk}-\frac{\omega_{tk}}{V_{tk}}. \tag{15}$$

The log likelihood of the latent variables given the observations is then:

$$L(U,V;X)\triangleq L(X;U,V)+L(U)+L(V) \tag{16}$$

The minorisation of eq(16), L'(Û, v̂, U, V), can be expressed as the minorisation of eq(3) plus minorisations of eq(14) and eq(15):

$$\mathcal{L}(\hat{U},U)=\sum_{f,k}-(\alpha_{fk}+1)\left(\ln\det U_{fk}-Tr\left(\hat{U}_{fk}U_{fk}^{-1}\right)+C\right)-Tr\left(\Omega_{fk}\hat{U}_{fk}^{-1}\right)$$

$$\mathcal{L}(\hat{U},U)\leq L(\hat{U})$$

$$\mathcal{L}(U,U)=L(U)$$

$$\mathcal{L}(\hat{V},V)=\sum_{t,k}-(\alpha'_{tk}+1)\left(\ln V_{tk}-\frac{V_{tk}}{\hat{V}_{tk}}+1\right)-\frac{\omega_{tk}}{\hat{V}_{tk}}$$

$$\mathcal{L}(\hat{V},V)\leq L(\hat{V})$$

$$\mathcal{L}(\hat{V},V)=L(V)$$

$$\mathcal{L}'(\hat{U},\hat{V},U,V)=\mathcal{L}(\hat{U},\hat{V},U,V)+\mathcal{L}(\hat{U},U)+\mathcal{L}(\hat{V}+V).$$

Setting the partial derivative of L' to zero now gives different values of A, B, A', B' from those described in the maximum likelihood estimator:

$$A_{fk}=(\alpha_{fk}+1)U_{fk}^{-1}+\sum_{t}\sigma_{ft}^{-1}V_{tk}M_{ftk}$$

-continued $$B_{fk} = \Omega_{fk} + U_{fk}\left(\sum_t M_{ftk} V_{tk} \sigma_{ft}^{-1} X_{ft} X_{ft}^H \sigma_{ft}^{-1}\right) U_{fk}$$

$$A'_{tk} = \frac{a'_{tk} + 1}{V_{tk}} + \sum_f Tr(\sigma_{ft}^{-1} U_{fk}) M_{ftk}$$

$$B'_{tk} = \omega_{tk} + V_{tk}^2 \sum_f M_{ftk} X_{ft}^X \sigma_{ft}^{-1} U_{fk} \sigma_{ft}^{-1} X_{ft}.$$

Apart from substituting these different values, the rest of the algorithm follows that outlined for the maximum likelihood.

Alternative Models

Alternative models may be employed within the PSTF framework we describe. For example:

- If the interchannel phases are assumed to be independent then $\psi_{ftk}$ and $\sigma_{ft}$ should be diagonal.
- If it is reasonable for all frequencies in a component to have the same covariance matrix apart from a scaling factor, then $U_{fk}$ can be further factorised into $Q_k \in \mathbb{C}_{C\times C}^{>0}$ and $W_{fk} \in \mathbb{R}^{>0}$ such that $U_{fk} \leftarrow Q_k W_{fk}$.
- The previous two options can be combined to give a masked NTF interpretation.
- The masked PSTF model collapses to a masked NMF model for mono.
- Conversely the masked NMF algorithm may be applied to each channel independently for a simpler implementation.

Note that these alternatives can have both maximum likehood and maximum posterior versions.

Interpolation

We perform the interpolation by applying a gain $G \in \mathbb{C}_{C\times C\times F\times T}$ to the input data X to calculate the output STFT $\in \mathbb{C}_{C\times F\times T}$:

$$Y_{ft} = G_{ft}^H X_{ft} \tag{17}$$

The expected output covariance $\sigma' \in [\mathbb{C}_{C\times C}^{>0}]_{F\times T}$ is then approximated by $\sigma'_{ft} = G_{ft}^H \sigma_{ft} G_{ft}$.

We now show two interpolation methods for calculating $G_{ft}$; the matching covariance method and the minimum mean square error method.

Matching Covariance Interpolator

We can calculate the expected covariance of the 'desired' data given the latent variables U, V as:

$$\tilde{\sigma}_{ft} = \sum_k \psi_{ftk} s_k. \tag{18}$$

We choose the gain such that the expected output covariance matches this 'desired' covariance. Hence the gains should satisfy:

$$\tilde{\sigma}_{ft} = G_{ft}^H \sigma_{ft} G_{ft} \tag{19}$$

The case where eq(19) is degenerate has to be treated as a special case. One possibility is to always add a small $\epsilon$ to the diagonals of both $\tilde{\sigma}_{ft}$ and $\sigma_{ft}$.

The set of possible solutions to eq(19) involves square root factorisations and an arbitrary orthonormal matrix $\Theta_{ft}$:

$$G_{ft} = \sigma_{ft}^{-1/2} \Theta_{ft} \tilde{\sigma}_{ft}^{1/2} \tag{20}$$

Given that there is a continuum of possible solutions to eq(20), we introduce another criterion to resolve the ambiguity; we find the solution that is as close as possible to the original in a Euclidean sense ($E\{\|X_{ft} - Y_{ft}\|^2\}$). We can find the optimal value of $\Theta_{ft}$ via singular value decomposition of the matrix $\tilde{\sigma}_{ft}^{1/2} \sigma_{ft}^{1/2H}$:

$$\tilde{\sigma}_{ft}^{1/2} \sigma_{ft}^{1/2H} = \pi \Sigma \beta^H \tag{21}$$

$$\Theta_{ft} = \rho \alpha^H \tag{22}$$

Substituting this result back into eq(20) and eq(17) gives the desired result.

$$Y_{ft} = \sigma_{ft}^{1/2} \alpha \beta^H \sigma_{ft}^{-1/2} X_{ft} \tag{23}$$

The algorithm is therefore:

1. For each frame t and frequency f:
   (a) For each k, use eq(1) to calculate $\psi_{ftk}$ from $U_{fk}$, $V_{tk}$,
   (b) Use eq(2) and eq(18) to calculate $\sigma_{ft}$ and $\tilde{\sigma}_{ft}$.
   (c) Use eq(21) to calculate $\alpha$, $\beta$.
   (d) Use eq(23) to $Y_{ft}$.

Minimum Mean Square Error

An alternative method of interpolation is the minimum mean square error interpolator. If we define $\tilde{Y} \in \mathbb{C}_{C\times F\times T}$ as the STFT of the desired components then one can minimise the expected mean square error between Y and $\tilde{Y}$. This leads to a time varying Wiener filter where $$G_{ft}^H = \tilde{\sigma}_{ft} \sigma_{ft}^{-1}$$

Example Implementation

Referring now to FIG. 1*a*, this shows a flow diagram of a procedure to restore an audio signal, employing an embodiment of an algorithm as described above. Thus at step S100 the procedure inputs audio data, digitising this if necessary, and then converts this to the time-frequency domain using successive short-time Fourier transforms (S102).

Figure 1B:
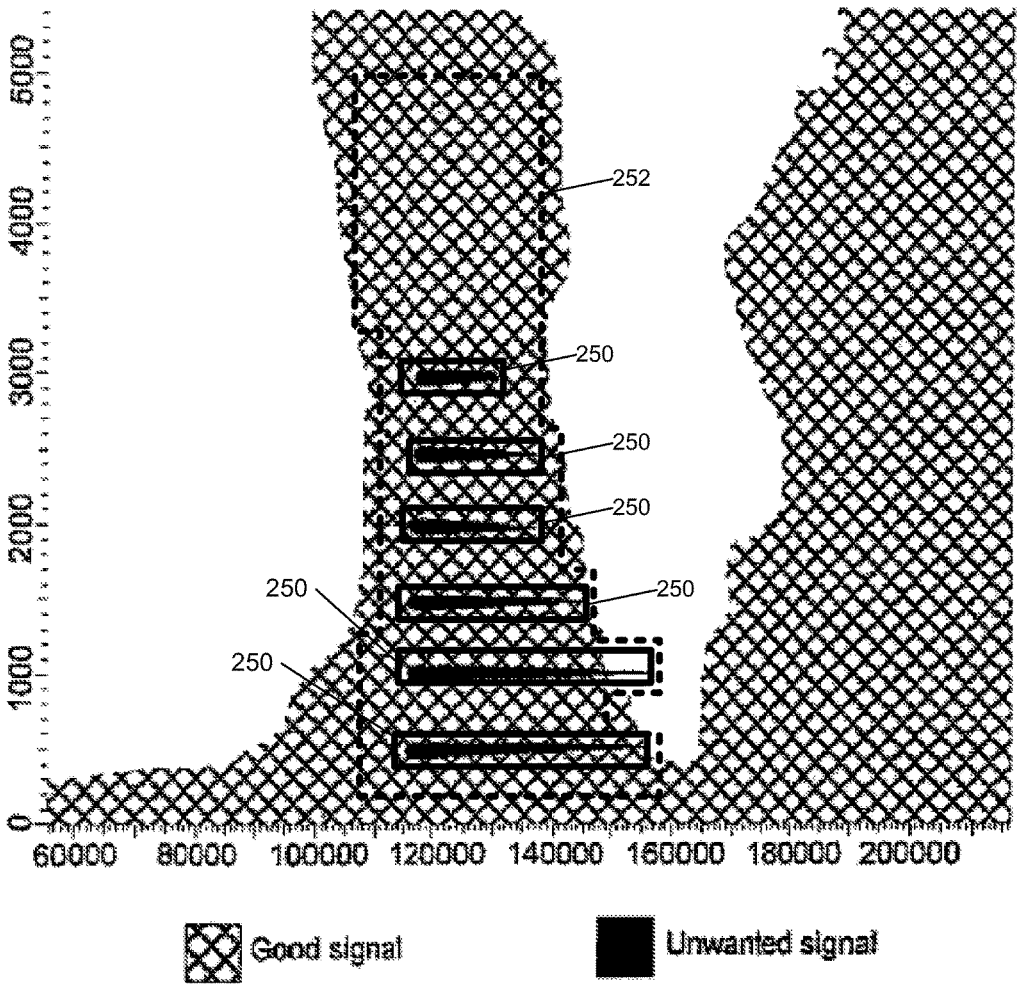

The procedure also allows a user to define 'desired' and 'undesired' masks, defining undesired and support regions of the time-frequency spectrum respectively (S104). There are many ways in which the mask may be defined but, conveniently, a graphical user interface may be employed, as illustrated in FIG. 1*b*. In FIG. 1*b* time, in terms of sample number, runs along the x-axis (in the illustrated example at around 40,000 samples per second) and frequency (in Hertz) is on the y-axis; 'desired' signal is cross-hatched and 'undesired' signal is solid. Thus FIG. 1*b* shows undesired regions of the time-frequency spectrum 250 delineated by a user drawing around the undesired portions of the spectrum (in the illustrated example the fundamental and harmonics of a car horn). In a similar manner a desired region of the spectrum 250 may also be delineated by the user. As illustrated, the defined regions need not be continuous and each of the 'desired' and 'undesired' regions may have an arbitrary shape. It is convenient if the shapes of the masks are drawn, in effect, at a resolution determined by the 'time-frequency pixels' of the STFT of step S102, though this is not essential. For example, in another approach the GUI uses an FFT size that depends upon the viewing zoom region but the processing employs an FFT size dependent on the size and shape of the selected regions. The restoration technique may be applied between two successive times (lines parallel to the y-axis in FIG. 1*b*), in which case the desired region may be assumed to be the entire time-frequency spectrum.

The desired and undesired regions of the time-frequency spectrum are then used to determine the mask $M_{tfk}$, where k labels the audio source components (S106). In embodiments a number of desired components and a number of undesired components may be determined a priori—for example, as mentioned above, using 2 desired and 2 undesired components works well in practice. The desired mask is applied to the desired components and the undesired mask to the undesired components of the audio signal.

Referring again to FIG. 1*a*, the procedure then initialises the latent variables U, V (S108) and iteratively updates these variables (S110) to determine a masked PSTF factorisation of the covariance $$\psi_{ftk} = M_{ftk} U_{fk} V_{tk}, \sigma_{ft} = \sum_k \psi_{ftk}.$$

The procedure then uses the desired components from the factorisation to calculate an expected desired covariance of these components as previously described (S112). A (complex) gain is then applied to the input signal (X) in the time-frequency domain (Y=GX, for example $Y_{ft}=\tilde{\sigma}_{ft}^{1/2}\alpha\beta^{H}\sigma_{ft}^{-1/2}X_{ft}$), so that the covariance of the restored audio output approximates the 'desired' covariance (S114). This restored audio is then converted into the time domain (S116), for example using a series of inverse discrete Fourier transforms. The procedure then outputs the restored time-domain audio (S118), for example as digital data for one or more audio channels and/or as an analogue audio signal comprising one or more channels.

Figure 2:
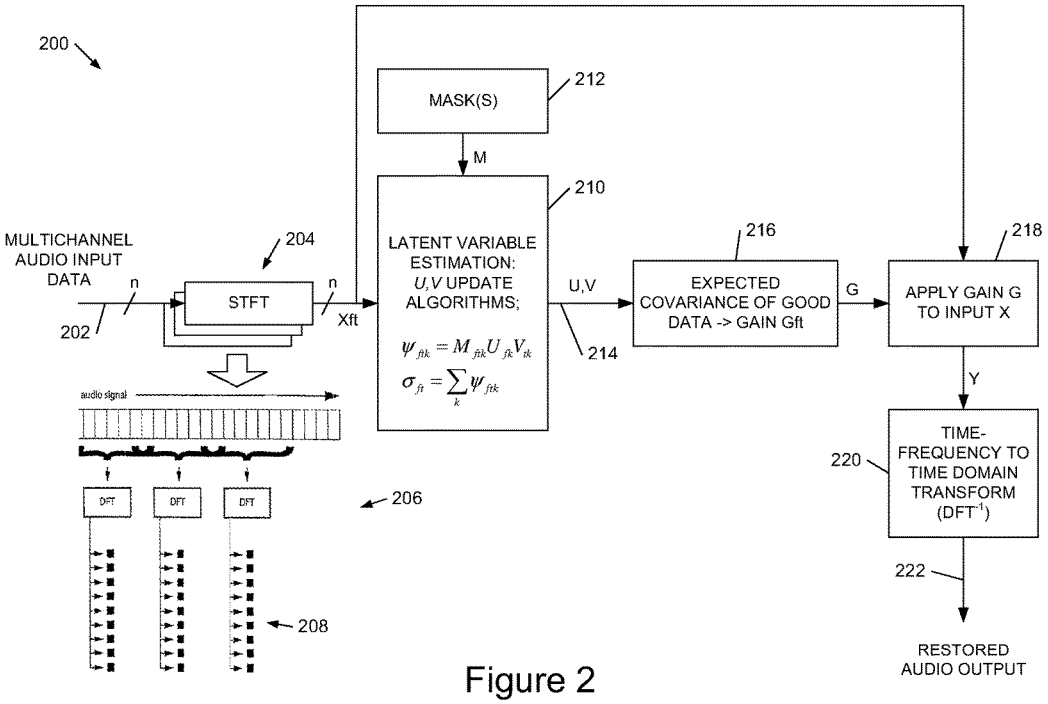
FIG. 2 shows a system configured to perform audio signal restoration using masked positive semi-definite tensor factorisation (PSTF) according to an embodiment of the invention.

FIG. 2 shows a system 200 configured to implement the procedure of FIG. 1*a*. The system 200 may be implemented in hardware, for example electronic circuitry, or in software, using a series of software modules to perform the described functions, or in a combination of the two. For example the Fourier transforms and/or factorization could be performed in hardware and the other functions in software.

In one embodiment audio restoration system 200 comprises an analogue or digital audio data input 202, for example a stereo input, which is converted to the time-frequency domain by a set of STFT modules 204, one per channel. Inset FIG. 206 shows an example implementation of such a module, in which a succession of overlapping discrete Fourier transforms are performed on the audio signal to generate a time sequence of spectra 208.

The time-frequency domain input audio data is provided to a latent variable estimation module 210, configured to implement steps S108 and S110 of FIG. 1*a*. This module also receives data defining one or more masks 212 as previously described, and provides an output 214 comprising factor matrices U, V. These in turn provide an input to a selection module 216, which calculates a gain, G, from the expected covariance of the desired components of the audio. An interpolation module 218 applies gain G to the input X to provide a restored output Y which is passed to a domain conversion module 220. This converts the restored signal back to the time domain to provide a single or multichannel restored audio output 222.

Figure 3:
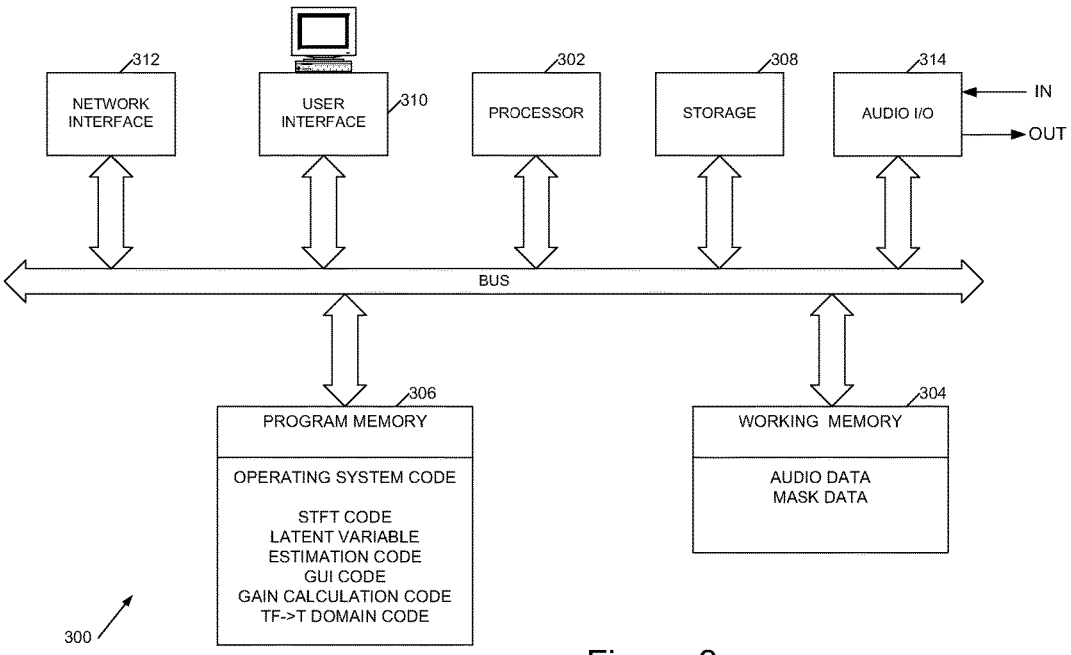
FIG. 3 shows a general purpose computing system programmed to implement the procedure of FIG. 1*a*.

FIG. 3 shows an example of a general purpose computing system 300 programmed to implement the procedure of FIG. 1*a*. This comprises a processor 302, coupled to working memory 304, for example for storing the audio data and mask data, coupled to program memory 306, and coupled to storage 308, such as a hard disc. Program memory 306 comprises code to implement embodiments of the invention, for example operating system code, STFT code, latent variable estimation code, graphical user interface code, gain calculation code, and time-frequency to time domain conversion code. Processor 302 is also coupled to a user interface 310, for example a terminal, to a network interface 312, and to an analogue or digital audio data input/output module 314. The skilled person will recognize that audio module 314 is optional since the audio data may alternatively be obtained, for example, via network interface 312 or from storage 308.

No doubt many other effective alternatives will occur to the skilled person. It will be understood that the invention is not limited to the described embodiments and encompasses modifications apparent to those skilled in the art lying within the spirit and scope of the claims appended hereto.

What is claimed is:

1. A method of restoring an audio signal, the method comprising:

inputting an audio signal for restoration;

determining a mask defining desired and undesired regions of a time-frequency spectrum of said audio signal, wherein said mask is represented by mask data;

determining estimated values for a set of latent variables, a product of said latent variables and said mask factorizing a tensor representation of a set of property values of said input audio signal;

wherein said input audio signal is modeled as a set of audio source components comprising one or more desired audio source components and one or more undesired audio source components, and wherein said tensor representation of said property values comprises a combination of desired property values for said desired audio source components and undesired property values for said undesired audio source components; and reconstructing a restored version of said audio signal from said desired property values of said desired source components;

wherein said set of property values of said input audio signal comprises a set of variance or covariance values comprising a combination of desired variance or covariance values for said desired audio source components and undesired variance or covariance values for said undesired audio source components; and wherein said reconstructing uses said desired variance or covariance values to reconstruct said restored version of said audio signal.

2. The method of claim 1 further comprising transforming said input audio signal into the time-frequency domain to provide a time-frequency representation of said input audio; and wherein said determining of estimated values for said set of latent variables comprises:

estimating a time-frequency varying variance or covariance matrix from said latent variables; and updating said latent variables using said time-frequency representation of said input audio, said time-frequency varying variance or covariance matrix, and said mask.

3. The method of claim 2 wherein said input audio signal comprises a plurality of audio channels, and wherein said time-frequency varying variance or covariance matrix comprises a matrix of inter-channel covariances.

4. The method of claim 2 wherein said input audio signal comprises one or more audio channels, and wherein said one or more channels are treated independently and wherein said tensor representation of said set of property values of each input audio channel comprises a rank 2 tensor.

5. The method of claim 1 wherein said mask data defines at least two masks, a first, desired mask defining a desired region of said spectrum and a second, undesired mask defining an undesired region of said spectrum, and wherein said determining of estimated values for said set of latent variables comprises applying said first mask to one or more said desired audio source components and applying said second mask to one or more said undesired audio source components.

6. A non-transitory data carrier carrying processor control code to implement the method of claim 1.

7. The method of claim 1 wherein said input audio signal comprises a plurality of audio channels, and wherein said set of property values of said input audio signal comprises a set of covariance values comprising a combination of desired covariance values for said desired audio source components and undesired covariance values for said undesired audio source components; and wherein said reconstructing uses said desired covariance values to reconstruct said restored version of said audio signal.

8. A method of restoring an audio signal, the method comprising:

inputting an audio signal for restoration;

determining a mask defining desired and undesired regions of a time-frequency spectrum of said audio signal, wherein said mask is represented by mask data;

determining estimated values for a set of latent variables, a product of said latent variables and said mask factorizing a tensor representation of a set of property values of said input audio signal;

wherein said input audio signal is modeled as a set of audio source components comprising one or more desired audio source components and one or more undesired audio source components, and wherein said tensor representation of said property values comprises a combination of desired property values for said desired audio source components and undesired property values for said undesired audio source components; and reconstructing a restored version of said audio signal from said desired property values of said desired source components;

further comprising determining estimated values for said set of latent variables such that a product of said latent variables and said mask factorizes a positive semi-definite tensor representation of said set of said property values, wherein said set of said property values is initially unknown.

9. The method of claim 8 wherein said input audio signal comprises a plurality of audio channels.

10. A method of restoring an audio signal, the method comprising:

inputting an audio signal for restoration;

determining a mask defining desired and undesired regions of a time-frequency spectrum of said audio signal, wherein said mask is represented by mask data;

determining estimated values for a set of latent variables, a product of said latent variables and said mask factorizing a tensor representation of a set of property values of said input audio signal;

wherein said input audio signal is modeled as a set of audio source components comprising one or more desired audio source components and one or more undesired audio source components, and wherein said tensor representation of said property values comprises a combination of desired property values for said desired audio source components and undesired property values for said undesired audio source components; and reconstructing a restored version of said audio signal from said desired property values of said desired source components;

wherein said property values comprise variance or covariance values of said input audio signal, and wherein said reconstructing comprises estimating a desired variance or covariance of said desired source components from said tensor representation of said set of variance or covariance values; the method further comprising adjusting said audio signal such that a variance or covariance of said audio signal approaches said estimated desired variance or covariance, to construct said restored version of said audio signal.

11. The method of claim 10 wherein said adjusting comprises applying a gain to said audio signal; the method further comprising estimating said variance or covariance values of said input audio signal, and calculating said gain from said estimated variance or covariance values of said input audio signal and said estimated desired variance or covariance.

12. The method of claim 10 wherein said input audio signal comprises a plurality of audio channels, wherein said property values comprise covariance values of said input audio signal, and wherein said reconstructing comprises estimating a desired covariance of said desired source components from said tensor representation of said set of covariance values; the method further comprising adjusting said audio signal such that a covariance of said audio signal approaches said estimated desired covariance, to construct said restored version of said audio signal.

13. A method of restoring an audio signal, the method comprising:

inputting an audio signal for restoration;

determining a mask defining desired and undesired regions of a time-frequency spectrum of said audio signal, wherein said mask is represented by mask data;

determining estimated values for a set of latent variables, a product of said latent variables and said mask factorizing a tensor representation of a set of property values of said input audio signal;

wherein said input audio signal is modeled as a set of audio source components comprising one or more desired audio source components and one or more undesired audio source components, and wherein said tensor representation of said property values comprises a combination of desired property values for said desired audio source components and undesired property values for said undesired audio source components;

reconstructing a restored version of said audio signal from said desired property values of said desired source components; and determining estimated values for latent variables $U_{fk}$, $V_{tk}$ where $$\psi_{ftk}=M_{ftk}U_{fk}V_{tk}$$

where $\psi$ comprises said tensor representation of said set of property values and M represents said mask, and where f, t and k index frequency, time and said audio source components respectively.

14. The method as claimed in of claim 13 comprising determining said estimated values for latent variables $U_{fk}$, $V_{tk}$ by finding values for $U_{fk}$, $V_{tk}$ which optimize a fit to the observed said audio signal, wherein said fit is dependent upon $\sigma_{ft}$, where $$\sigma_{ft} = \sum_k \psi_{ftk}$$

15. The method of claim 13 wherein $U_{fk}$ is further factorized into two or more factors.

16. The method of claim 13 wherein $U_{fk}$ comprises a covariance matrix.

17. A method of restoring an audio signal, the method comprising:

inputting an audio signal for restoration;

determining a mask defining desired and undesired regions of a time-frequency spectrum of said audio signal, wherein said mask is represented by mask data;

determining estimated values for a set of latent variables, a product of said latent variables and said mask factorizing a tensor representation of a set of property values;

wherein said input audio signal is modeled as a set of audio source components comprising one or more desired audio source components and one or more undesired audio source components, and wherein said tensor representation of said property values comprises a combination of desired property values for said desired audio source components and undesired property values for said undesired audio source components;

reconstructing a restored version of said audio signal from said desired property values of said desired source components;

transforming said input audio signal into the time-frequency domain to provide a time-frequency representation of said input audio; and wherein said tensor representation of said set of property values comprises an unknown variance or covariance ψ that varies over time and frequency and is given by $$\psi_{ftk}=M_{ftk}U_{fk}V_{tk}$$

wherein M has F×T×K elements defining said mask, wherein ψ has F×T×K elements, and wherein F is a number of frequencies in said time-frequency domain, T is a number of time frames in said time-frequency domain, and K is a number of said audio source components;

wherein $U_{fk}$ is a positive semi-definite tensor with F×K elements; and wherein $V_{tk}$ is a non-negative matrix with T×K elements defining activations of said desired and undesired audio source components;

wherein said determining of estimated values for said set of latent variables comprises iteratively updating $U_{fk}$ and $V_{tk}$ using a variance or covariance matrix $\sigma_{ft}$, $$\sigma_{ft}=\sum_k \psi_{ftk}$$

wherein said reconstructing comprises determining desired variance or covariance values $$\tilde{\sigma}_{ft}=\sum_k \psi_{ftk}s_k$$

for said desired audio source components, where $s_k$ is a selection vector selecting said desired audio source components; and reconstructing said restored version of said audio signal by adjusting said input audio signal to approach said desired variance or covariance values $\tilde{\sigma}_{ft}$.

18. A method of processing an audio signal, the method comprising:

receiving an input audio signal for restoration;

transforming said input audio signal into the time-frequency domain;

determining mask data for a mask defining desired and undesired regions of a spectrum of said audio signal;

determining estimated values for latent variables $U_{fk}$, $V_{tk}$ where $$\psi_{ftk}=M_{ftk}U_{fk}V_{tk}$$

wherein said input audio signal is modeled as a set of k audio source components comprising one or more desired audio source components and one or more undesired audio source components, and where $\psi_{ftk}$ comprises a tensor representation of a set of property values of said audio source components, where M represents said mask, and where f and t index frequency and time respectively; and constructing a restored version of said audio signal from desired property values of said desired source components.

19. The method of claim 18 wherein ψ comprises an initially unknown variance or covariance of said audio source components of said input audio signal.

20. The method of claim 18 comprising determining said estimated values for latent variables $U_{fk}$, $V_{tk}$ by finding values for $U_{fk}$, $V_{tk}$ which optimize a fit to the observed said audio signal, wherein said fit is dependent upon $\sigma_{ft}$, where $$\sigma_{ft}=\sum_k \psi_{ftk}$$

21. A non-transitory data carrier carrying processor control code to implement the method of claim 18.

22. Apparatus for restoring an audio signal, the apparatus comprising:

an input to receive an audio signal for restoration;

an output to output a restored version of said audio signal;

program memory storing processor control code, and working memory; and a processor, coupled to said input, to said output, to said program memory and to said working memory to process said audio signal;

wherein said processor control code comprises code to:

input an audio signal for restoration;

determine a mask defining desired and undesired regions of a spectrum of said audio signal, wherein said mask is represented by mask data;

determine estimated values for latent variables $U_{fk}$, $V_{tk}$ where $$\psi_{ftk}=M_{ftk}U_{fk}V_{tk}$$

wherein said input audio signal is modeled as a set of k audio source components comprising one or more desired audio source components and one or more undesired audio source components, and where $\psi_{ftk}$ comprises a tensor representation of a set of property values of said audio source components, where M represents said mask, and where f and t index frequency and time respectively; and construct a restored version of said audio signal from said desired source components.

23. The apparatus of claim 22 wherein $U_{fk}$ is further factorized into two or more factors.

* * * * *